United States Patent [19]

Dewey

[11] Patent Number: 4,630,062

[45] Date of Patent: Dec. 16, 1986

[54] HORN ANTENNA WITH WIDE FLARE ANGLE

[75] Inventor: Richard J. Dewey, Reigate, United Kingdom

[73] Assignee: U.S. Philips Corporation, New York, N.Y.

[21] Appl. No.: 750,654

[22] Filed: Jul. 1, 1985

Related U.S. Application Data

[63] Continuation of Ser. No. 414,089, Sep. 1, 1982, abandoned.

[30] Foreign Application Priority Data

Sep. 7, 1981 [GB] United Kingdom ..... 8127037
Jul. 14, 1982 [GB] United Kingdom ..... 8220384

[51] Int. Cl.[4] ..... H01Q 13/06
[52] U.S. Cl. ..... 343/786
[58] Field of Search ..... 343/786, 773, 774, 772, 343/773, 775

[56] References Cited

U.S. PATENT DOCUMENTS 2,415,807 2/1947 Barrow et al. ..... 343/786

FOREIGN PATENT DOCUMENTS 2090068 6/1982 United Kingdom ..... 343/786

*Primary Examiner*—John S. Heyman
*Assistant Examiner*—K. Ohralik
*Attorney, Agent, or Firm*—Robert J. Kraus

[57] ABSTRACT

A horn antenna suitable for an amplitude-comparison broadband direction-finding system with 360° azimuth coverage comprises a horn with a wide angle of flare in a plane normal to the z-axis of a cylindrical co-ordinate system and an aperture which is suitably cylindrical, as seen from that axis, and further comprises means for launching electromagnetic energy into the horn towards the aperture. In order to provide a substantially constant beamwidth over a broad frequency range, which may be as wide as 7:1, the horn and launching means are adapted to launch and propagate to the aperture a substantially pure lowest order circumferential mode having its electric field in a direction parallel to the z-axis, the launching means acting substantially as a line source coincident with the z-axis. The flare angle may be 180 degrees, and the launching means may comprise an electric probe extending substantially along the z-axis.

8 Claims, 5 Drawing Figures

HORN ANTENNA WITH WIDE FLARE ANGLE

This is a continuation of application Ser. No. 414,089, filed Sept. 1, 1982 now abandoned.

BACKGROUND OF THE INVENTION

This invention relates to a horn antenna for a main beam with a broad beamwidth in the H-plane of the antenna, the beamwidth varying with frequency substantially less than the usual nominal inverse proportionality to frequency.

More particularly, the invention relates to a horn antenna comprising a horn having an aperture and further comprising means for launching electromagnetic energy into the horn towards the aperture. With reference to a cylindrical co-ordinate system with parameters z, $\phi$ and r, z representing distance masured parallel to a rectilinear z-axis from a plane normal thereto, $\phi$ representing an angle measured about the z-axis from a datum and r representing radial distance from the z-axis, the horn has a wide angle of flare about the z-axis in the $\phi$, r plane. The angle is less than 360 degrees, and the horn is bounded over the whole of the angle of flare by conductive surfaces spaced apart in the z-direction. Since an antenna is reciprocal in nature, the launching means are to be understood to mean additionally or alternatively means for receiving electromagnetic energy propagating in the horn.

Such an antenna may be used in a broad-band direction-finding system comprising a set of N adjacent similar such antennae whose respective main beam axes are spaced at regular angular intervals of (360/N) degrees (normally in azimuth). An R.F. source whose direction relative to the system is to be found may be detected by summing the output signals of all the antennae, and the direction may be established by comparing the magnitudes of the output signals of a suitable pair of adjacent antennae of the set. In order to provide substantially the same probability of detection of an R.F. source for all angles in azimuth and in order to provide optimum accuracy in establishing the direction of the source, it is desirable that the power level of an antenna main beam (relative to its peak level) in a direction corresponding to the main beam axis of an adjacent antenna, i.e. at an angle of $\pm(360/N)$ degrees to its own main beam axis, should lie approximately in the range of $-8$ dB to $-15$ dB over the operating frequency range of the system.

An antenna as set forth in the second paragraph of this specification is disclosed in the Applicants' copending U.K. Patent Application 8041126 (G.B. 2090068A). In that antenna, electromagnetic energy is launched into the horn towards the aperture (or mouth) of the horn by a rectangular waveguide having a pair of opposed E-plane ridges. In order to obtain a substantially constant beamwidth over an operating frequency range of 3:1 which includes a band of frequencies immediately above the cut-off frequency of the $TE_{30}$ mode, the ridges are spaced along the waveguide from the throat of the horn: the generation of the $TE_{30}$ mode by the ridged waveguide is so phased with respect to the horn as to minimize variations of beamwidth with frequency in the band immediately above the $TE_{30}$ cut-off frequency. The antenna is suitable for an above-mentioned direction-finding system wherein N=8.

SUMMARY OF THE INVENTION

It is an object of the invention to provide an improved horn antenna. It is particularly desirable to provide such an antenna for a broadband direction-finding system such as set forth in the third paragraph of this specification whereby the system may operate over a greater bandwidth with the same number (i.e. eight) of antennae or, especially, whereby the system may require fewer antennae while operating over a similar or possibly a greater bandwidth.

According to the invention, a horn antenna as set forth in the second paragraph of this specification is characterised in that the launching means acts substantially as a line source coincident with the z-axis and in that the launching means and horn are together adapted to launch and propagate to the aperture a substantially pure lowest order circumferential mode having its electric field in a direction parallel to the z-axis. Such a mode has components $E_z$, $H_\phi$ and $H_r$ only.

It may be noted that U.S. Pat. No. 2,944,258 discloses an antenna comprising a pair of oppositely disposed conductive ridges mounted perpendicular to a ground plane, a pair of curved surfaces on the facing inner ridge portions converging at a predetermined radius of curvature toward the ground plane and terminating a selected distance therefrom, thereby forming an antenna mouth and throat respectively, and an exciter element parallel to the ground plane across the antenna throat. This antenna is not a horn antenna, being distinguished in the Patent from various kinds of prior art antennas including horn antennas. It has no clearly recognisable angle of flare, and is bounded by conductive surfaces spaced apart in the z-direction only over the relatively narrow width of the ridges. While the exciter element disclosed in the Patent is suitable for launching the desired substantially pure lowest order circumferential mode used in embodiments of the present invention, the ridge structure is inherently unsuitable for propagating this pure mode even to the relatively narrow so-called mouth of the antenna, let alone to an antenna aperture extending over a wide angle of flare. The radiation pattern is said to be dependent on the relative sizes of the ridges and the ground plane, and must be determined wholly empirically: it is apparently not possible to predict whether a desired radiation pattern could be produced and if so, how. The dependence of the radiation pattern on the size of the ground plane and hence on the detailed configuration of the surroundings in which the ridges are mounted, and the wholly empirical nature of the antenna design are, inter alia, factors which make the antenna unsuitable for amplitude-comparison direction-finding system, in which predetermined radiation patterns of good quality must be quite accurately maintained over the desired operating frequency range and reproducible from one antenna and operating environment to another.

An antenna embodying the invention may have a flare angle in the $\phi$, r plane substantially greater than 130 degrees, the highest value referred to in the above-mentioned U.K. Patent Application, thus providing a substantially greater beamwidth which may be relatively constant over a broad frequency range.

The horn may be bounded in the $\phi$, r plane by conductive surfaces which extend from the aperture towards the z-axis at least to within a distance of the z-axis that is substantially less than a wavelength throughout the operating frequency range of the antenna.

The effective electrical spacing of the aperture from the z-axis may be substantially less than a wavelength at the lowest frequency in the operating frequency range of the antenna.

It may be mentioned that the known biconical antenna has a H-plane flare angle of 360 degrees and produces an omnidirectional radiation pattern. However, the effect on the radiation pattern over a broad-band of reducing the H-plane angle of flare, for example by introducing two conductive walls extending radially between the cones in planes including the axis of the cones, could not readily be predicted; the beamwidth might reasonably by expected to decrease with increasing frequency as usual.

To assist in obtaining the desired substantially pure mode, said conductive surfaces spaced apart in the z-direction may extend substantially from the aperture to the z-axis, the launching means may be situated substantially at the z-axis, and the extent of the launching means in the $\phi$, r plane may be small compared with a wavelength over the the operating frequency range. Alternatively or additionally, the launching means may be substantially rotationally symmetrical about the z-axis over substantially the whole of the angle of flare. The launching means may comprise an electric probe extending substantially along the z-axis. Such a probe inherently acts as a line source in the horn, and is particularly suitable for use with a coaxial line as a transmission line feeder for the antenna. With this form of launching means, the antenna suitably comprises a cavity of which at least part is radially opposed to the horn and which is configured such that, over at least the majority of the operating frequency range of the antenna, the impedance presented to the launching means by the cavity is substantially greater than the impedance presented by the horn. Electromagnetic energy which is coupled out of the launching means but which initially travels away from the horn aperture may thus be mainly reflected back for radiation at the aperture. The cavity may extend around the z-axis over an angle of substantially 360 degrees minus the angle of flare, so that energy which does not initially travel towards the aperture may be reflected back towards the launching means.

For each point at the aperture of the horn, the phase length between the point and the launching means may be substantially the same as for all other points at the aperture in the same plane normal to the z-axis, thereby providing a suitable wavefront at the aperture for constant beamwidth over a very broad frequency band. Such performance may be obtained with an embodiment in which alternatively or additionally the aperture is part of a substantially cylindrical surface having the z-axis as its axis of revolution.

To improve the match between the launching means and free space, the spacing parallel to the z-axis of said conductive surfaces may increase progressively with increasing r, suitably exponentially.

BRIEF DESCRIPTION OF THE DRAWING

Embodiments of the invention will now be described, by way of example, with reference to the accompanying diagrammatic drawing, in which.

DESCRIPTION OF THE PREFERRED EMBODIMENTS

Figure 1:
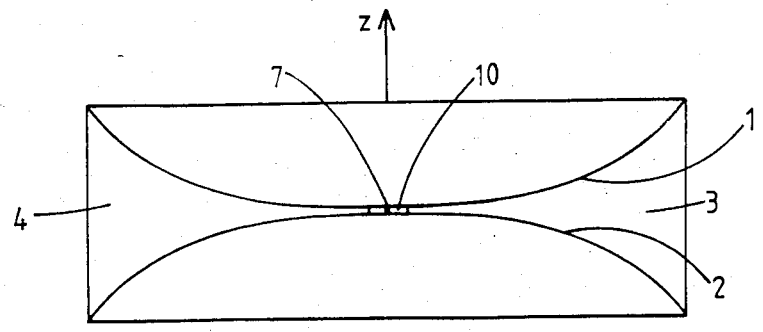
FIG. 1 is a front view of a horn antenna embodying the invention, the Figure showing the z-axis of a cylindrical co-ordinate system.
Figure 2:
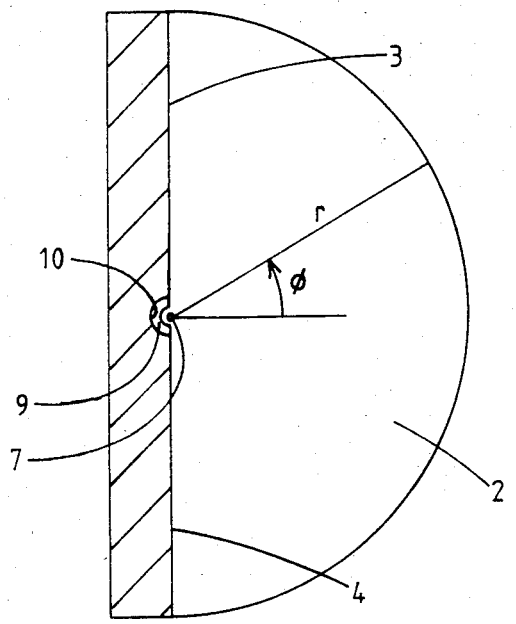
FIGS. 2 and 3 are cross-sectional views of the antenna respectively in a plane normal to the z-axis and in a plane including the z-axis, FIG. 3 being at twice the scale of FIGS. 1 and 2.
Figure 3:
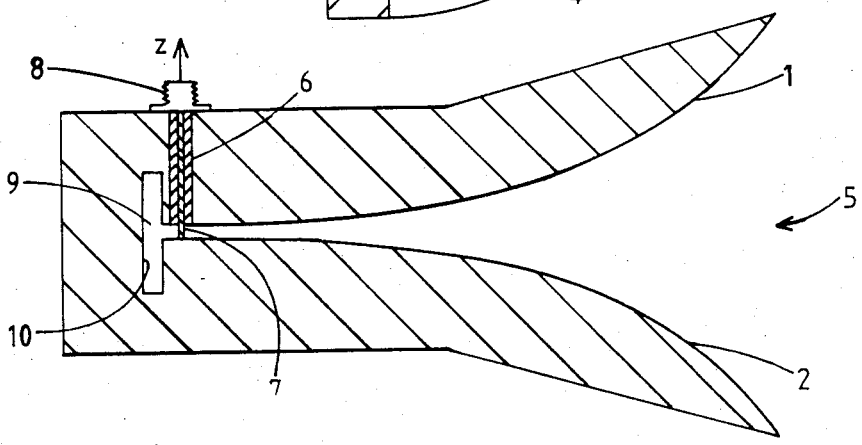

Referring to FIGS. 1–3, FIG. 1 is a front view of a horn antenna looking into the aperture of the horn along the axis of the main beam of the antenna, i.e. the line defined by $z=0$, $\phi=0$. The plane $z=0$ normal to the z-axis is a plane of mirror symmetry of the horn. FIG. 2 is a cross-sectional view of the antenna in this plane. FIG. 3 is a cross-sectional view of the antenna in a plane including the z-axis at $\phi=0$. The z-axis is shown in FIG. 3 as well as in FIG. 1, and the parameters $\phi$, r for an arbitrarily selected point at the aperture of the horn are shown in FIG. 2.

The horn is bounded by spaced, curved conductive surfaces 1, 2 which (as indicated in FIG. 2) when projected onto a plane normal to the z-axis each extend over a semicircle centred on the z-axis; as shown in FIGS. 1 and 3, the spacing between the surfaces in the z-direction increases progressively, in this case exponentially, with increasing distance from the z-axis. In this embodiment, the horn is further bounded by conductive surfaces 3, 4 which lie in planes including the z-axis at $\phi=+90$ degrees and $\phi=-90$ degrees respectively, i.e. they are coplanar. The horn thus has a flare angle of 180 degrees in the $\phi$, r plane (which is the H-plane of the antenna). The portions of the peripheries of the surfaces 1, 2 lying in the range $-90° \leqq \phi \leqq 90°$ determine the shape of the horn aperture. More specifically, in this embodiment said portions of the peripheries are semicircles which have the same radius, which lie in respective planes normal to the z-axis, and which are centred on the z-axis, and the aperture of the horn is thus half the surface of a cylinder having the z-axis as its axis of revolution.

Electromagnetic energy can be supplied to or derived from the horn along a coaxial line feeder 6 centred on the z-axis. To form launching means, the inner conductor 7 of the line extends beyond one end of the line across the gap between the conductive surfaces 1 and 2 and is conductively connected to the surface 2. The other end of the line is connected to an SMA connector 8 (shown in outline).

As shown, the conductive surfaces 1, 2 in this embodiment extend from the aperture of the horn substantially to the z-axis and beyond it to a semi-annular cavity 9 radially opposed to the horn. The axial length of the cavity, i.e. its dimension parallel to the z-axis, is chosen to be much greater than the spacing between the surfaces 1 and 2 adjacent the cavity so as to have a much higher characteristic impedance. The radial distance between the short-circuiting back wall 10 of the cavity and the conductor 7 is chosen to be approximately a quarter wavelength near the top of the operating frequency range of the antenna.

In operation, the portion of the conductor 7 extending between the surfaces 1, 2 constitutes an electric probe for launching electromagentic energy into the horn towards its aperture, the probe acting as a mode transducer from the TEM mode of the coaxial line 6. Since the probe is located on the axis of rotational symmetry of the horn, has a very small extent in the $\phi$, r plane compared both with the aperture of the horn and with the wavelength throughout the operating frequency range, and extends in the z-direction, it is particularly suited to launching substantially only the lowest order circumferential mode having its electric field in a direction parallel to the z-axis and having no variation of electric field in that direction. Circumferential modes with such electric fields have components $E_z$, $H_\phi$ and $H_r$ only, where $E_z$ varies with $\phi$ in such a manner that for an aperture extending between $\pm\Phi$ degrees, $E_z=0$ at $\phi=\pm\Phi$; for the lowest order circumferential mode, $E_z$ varies with $\phi$ as cos $90(\phi|\Phi)$.

It should be noted that while the horn of course has an aperture or mouth, it does not have a distinct throat as found in conventional horns. Such a throat usually both results in a cut-off frequency, at which the width of the throat in the H-plane of the antenna is half a wavelength and below which the horn will not propagate electromagnetic energy in the desired mode, and at higher frequencies constitutes a generator of undesired higher-order modes in the horn. The absence of such a throat is therefore especially helpful in obtaining consistent performance over a broad frequency band, and while the lowest order circumferential mode in the horn is fairly similar to the fundamental $TE_{10}$ mode in rectangular waveguide, the antenna does not appear to have a similar cut-off frequency.

Figure 4:
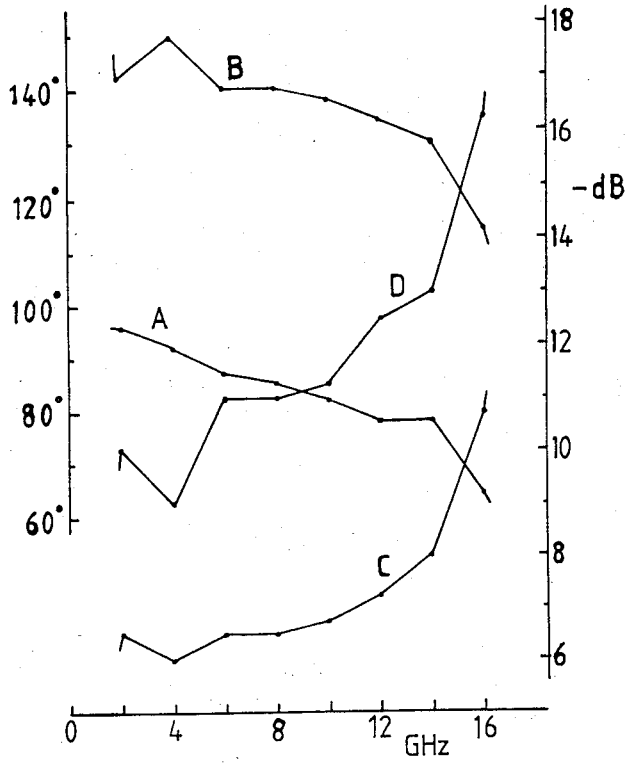
FIG. 4 is a graph of beamwidths and beam power levels.

A horn antenna of the form shown in FIGS. 1–3 has been constructed and found to show surprisingly little variation of beamwidth with frequency over a very broad frequency range. FIG. 4 is a graph of beamwidths in degrees (left-hand vertical scale) and power levels in dB relative to peak (right-hand vertical scale) against frequency, plotted at intervals of 2 GHz over the range of 2–16 GHz. Line A is 3 dB beamwidth, line B is 10 dB beamwidth, line C is the power level at $\phi=\pm60$ degrees (corresponding to N=6 antennae for the above-mentioned direction-finding system), and line D is the power level at $\phi=\pm72$ degrees (corresponding to N=5). It will be seen that the variations with frequency are far less than would be expected from the usual inverse proportionality, especially between 2 GHz and 14 GHz, i.e. a frequency range of 7:1. In that range, the 3 dB beamwidth only varied between 78 degrees and 96 degrees, and the power level at $\pm72$ degrees lies between $-9$ dB and $-13$ dB, so that a very broad-band direction-finding system comprising five such antennae would effect a substantial reduction in the required equipment by comparison with a system comprising eight antennae as disclosed in the above-mentioned U.K. Patent Application No. 8041126, both by reducing the number of channels required to cover the total azimuth of 360 degrees and by reducing the number of sub-systems required to cover a frequency range substantially greater than 3:1. The radiation patterns of the constructed embodiment were found to be of high quality at each frequency of measurement in the range 2–16 GHz, indicating that a substantially pure lowest order circumferential mode is launched in the horn and, of course, propagated to the aperture.

Figure 5:
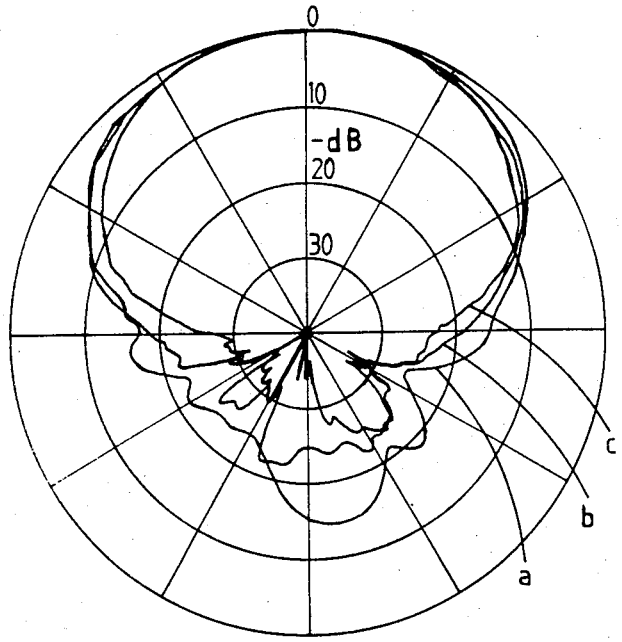
FIG. 5 shows radiation patterns.

FIG. 5 shows three of these radiation patterns in dB relative to peak power, the circles being spaced at intervals of 10 dB and the radial lines being spaced at intervals of 30 degrees. Line a was obtained at 2 GHz, line b at 8 GHz and line c at 14 GHz. The remarkable similarity of the patterns over the majority of the forward sector can be seen.

The dimensions of the constructed embodiment were as follows: the radius of the horn aperture was 100 mm; the spacing of the conductive surfaces 1 and 2 was 2 mm at the launching probe and 70 mm at the aperture, the spacing of each surface from the plane z=0 of mirror symmetry increasing between r=3 mm and r=100 mm according to the function $$z=\exp[0.036653(r-3)];$$

the inner and outer diameters of the semi-annular cavity 9 were 6 mm and 12.5 mm, and its axial length was 20 mm. The spacing of the axial end walls of the cavity was thus 10 times the spacing of the surfaces 1 and 2 at the probe, providing a much higher characteristic impedance, while the increasing separation of the surfaces 1 and 2 towards the aperture of the horn helped to provide a match between the horn at the launching means and free space. The inner and outer diameters of the coaxial line feeder were 1.3 mm and 4.1 mm respectively.

Experiments with a horn antenna of the kind disclosed in the above-mentioned U.K. Patent Application No. 8041126 indicate that the use of an aperture which forms part of the surface of the cylinder rather than a conventional rectangular aperture prevents deterioration of the radiation pattern only towards the bottom of its operating frequency range, e.g. in the case of an antenna having an operating frequency range of 3.2–10.5 HGz with a cylindrical aperture, only below about 4 GHz. It is therefore thought that the aperture of a horn antenna embodying the present invention may for example be less sharply curved than a cylindrical surface centred on the z-axis and tangential to at least part of the aperture.

Other forms of electric probe launching means may be used. For example, the probe may extend only part of the way across the gap between the conductive surfaces 1 and 2 and may be thickened at its free end to form a "doorknob". Measurements on an embodiment with such a probe indicate good radiation performance at frequencies up to 18 GHz. Such other forms of probe may introduce a variation into the electric field in the z-direction.

The cavity 9 is thought to constitute an important factor limiting the operating bandwidth of the antenna. By selecting the spacing between the launching probe and the short-circuiting semi-cylindrical wall of the cavity to be a quarter wavelength at or near the top of the operating frequency range, the cavity will present a very high impedance to the launching probe at the top of the range. However, as the operating frequency decreases and this spacing becomes a progressively smaller fraction of a quarter wavelength, the impedance presented to the probe by the cavity will progressively decrease. This effect may be mitigated by making the characteristic impedance of the cavity much greater than that of the horn at the launching probe, as indicated above, so that the impedance presented by the cavity to the probe may be greater than that presented by the horn over at least the majority of the operating frequency range, but as the frequency is decreased, the impedance presented by the cavity will inevitably decrease to a small value and constitute a significant mismatch.

An alternative form of launching means is a circular waveguide extending into the horn along the z-axis, the waveguide having an aperture in its cylindrical wall within the horn. The aperture may be a slot extending circumferentially over substantially the whole of the angle of flare of the horn, the slot being bounded by a pair of edges in respective $\phi$, r planes spaced by less than the spacing between the bounding conductive surfaces of the horn that are spaced apart in the z-direction. The launching means are then substantially rotationally symmetrical about the z-axis over substantially the whole of the angle of flare (as of course is the electric probe). No cavity radially opposed to the horn is required. The circular waveguide may be terminated in a short-circuit approximately a quarter wavelength beyond the slot, or a mitred bend may be used to effect a smooth transition from the circular to the radial waveguide.

Other forms of launching means may be used, for example a magnetic loop. This may have the advantage that it is suitable for use immediately adjacent a short-circuiting conductive wall perpendicular to the plane of the loop, and may therefore alleviate the limitation on the operating bandwidth imposed by a cavity in combination with an electric probe, as described above.

Where energy is to be coupled into or out of the antenna at R.F., the antenna is suitably used with a transmission line feeder extending from the launching means and supporting a TEM or quasi-TEM mode, as with the coaxial feeder 6 in the above-described embodiment. However, where for example an antenna is to be used only for the detection of radiation, a suitable diode may be located substantially on the z-axis and be provided with means for coupling it to a substantially pure lowest order radial mode in the horn, these means then constituting the launching means of the invention.

It will be seen that as a result of the rotationally symmetrical form of the above-described embodiment (for $-90° \leqq \phi \leqq 90°$) and since the launching means acts as a line source on the axis of symmetry, the phase length between the launching means and any point at the aperture is substantially the same as for all other points at the aperture in the same plane normal to the z-axis. This may also be achieved for apertures which do not form part of a substantially cylindrical surface, for example by including dielectric material in the horn and/or by suitable shaping of the conductive surfaces 1 and 2.

A mathematical model has been devised for the radiation patterns of antennae embodying the invention, using the assumption that the E-plane and H-plane radiation patterns are separable and that the H-plane radiation pattern may therefore be predicted by taking the spacing in the z-direction between conductive surfaces bounding the horn to be uniform, as in a sectoral horn. The model gives results in good agreement with the measured performance of the above-described constructed embodiment, and may be used to predict the radiation patterns of embodiments having H-plane flare angles other than 180 degrees; for example, it is expected that a flare angle of 300 degrees will result in a 3 dB beamwidth of approximately 120 degrees.

An antenna embodying the invention may be used with a polarisation twister adjacent the horn at its aperture so that, for example, when used in an azimuth direction-finding system, the system can respond to both horizontally and vertically-polarised radiation by rotating the plane of polarisation of the incident radiation through 45 degrees.

I claim:

1. A horn antenna comprising a feed element, first and second spaced-apart conductive surfaces cooperating to define an inwardly-disposed gap at which the feed element is situated and an outwardly-disposed aperture, and first and second planar conductive surfaces defining a predetermined flare angle, the antenna being configured with respect to a cylindrical coordinate system having z, $\phi$ and r axes such that:

(a) projections of the first and second spaced-apart conductive surfaces onto a plane defined by the r, $\phi$ axes form coextensive sectors of a circle covering the predetermined flare angle and are bounded by said first and second planar conductive surfaces, each of which lies in a respective plane defined by the r, z axes;

(b) intersections of the first and second spaced-apart conductive surfaces with any plane defined by the r, z axes form first and second curves symmetrically disposed on opposite sides of the r, $\phi$ plane, separated by a predetermined distance at the gap, and diverging with distance from the z-axis until terminating at the aperture; and (c) said feed element comprises a line source extending along the z-axis and having a width which is small in comparison to wavelengths corresponding to frequencies at which the antenna is intended to operate;

said feed element, spaced-apart conductive surfaces and planar conductive surfaces cooperating to launch and propagate to said aperture a substantially pure lowest order circumferential mode having its electric field in a direction parallel to the z axis and having magnetic field components in only the r and $\phi$ directions.

2. A horn antenna comprising a feed element, first and second spaced-apart conductive surfaces cooperating to define an inwardly disposed gap at which the feed element is situated and an outwardly disposed aperture, and first and second planar conductive surfaces defining a predetermined flare angle, the antenna being configured with respect to a cylindrical coordinate system having z, $\phi$ and r axes such that:

(a) projections of the first and second spaced-apart conductive surfaces onto a plane defined by the r, $\phi$ axes form coextensive sectors of a circle covering the predetermined flare angle and are bounded by said first and second planar conductive surfaces, each of which lies in a respective plane defined by the r, z axes;

(b) intersections of the first and second spaced-apart conductive surfaces with any plane defined by the r, z axes form first and second curves symmetrically disposed on opposite sides of the r, $\phi$ plane, separated by a predetermined distance at the gap, and diverging with distance from the z-axis until terminating at the aperture; and (c) said feed element comprises a line source extending along the z-axis and having a width which is small in comparison to wavelengths corresponding to frequencies at which the antenna is intended to operate;

said horn antenna further including a portion thereof defining a cavity communicating with the inwardly disposed gap, said cavity extending alongside the z-axis in both directions from the gap to an axial length which is large in comparison to said predetermined distance, and having a cross-sectional shape such that intersection of the cavity with a plane perpendicular to the z-axis forms a sector of an annulus covering an angle around said axis complementing the predetermined flare angle covered by said sectors of the circle.

3. A horn antenna as in claim 2 where said first and second conductive surfaces intersect the z axis.

4. A horn antenna as in claim 2 or 3 where the feed element is symmetrically disposed about the z-axis at least over the predetermined flare angle.

5. A horn antenna as in claim 2 where ends of the first and second conductive surfaces defining the inwardly disposed gap are spaced from the z-axis by a distance which is substantially smaller than wavelengths corresponding to frequencies at which the antenna is intended to operate.

6. A horn antenna as in claim 2 or 3 where ends of the first and second conductive surfaces defining the outwardly disposed aperture are spaced from the z-axis by a distance which is substantially smaller than a wavelength corresponding to the antenna's lowest operating frequency.

7. A horn as in claim 2 or 3 where the spacing between said curves increases exponentially with r.

8. A horn antenna as in claim 2 or 3 where said predetermined flare angle is approximately 180°.

* * * * *